United States Patent [19]

Münstedt

[11] 4,224,611

[45] Sep. 23, 1980

[54] SMOKE ALARM STATION

[76] Inventor: Wolfgang Münstedt, Goffineweg 11, 5 Köln 80, Fed. Rep. of Germany

[21] Appl. No.: 890,710

[22] Filed: Mar. 24, 1978

[30] Foreign Application Priority Data

Mar. 25, 1977 [DE] Fed. Rep. of Germany ..... 2713280

[51] Int. Cl.[2] ..... G08B 17/10

[52] U.S. Cl. ..... 340/629; 250/381; 340/530; 340/664

[58] Field of Search ..... 340/628, 629, 530, 664; 250/381, 382, 384, 385

[56] References Cited

U.S. PATENT DOCUMENTS

| | | | |
|---|---|---|---|
| 3,530,450 | 9/1970 | Walthard et al. | 340/629 |
| 3,655,289 | 4/1972 | Walker | 356/207 X |
| 3,665,461 | 5/1972 | Gnägi et al. | 340/628 |
| 3,676,680 | 7/1972 | Scheidweiler | 340/629 |
| 3,798,625 | 3/1974 | McMillian et al. | 340/527 |
| 3,866,195 | 2/1975 | Ried, Jr. | 340/629 |
| 3,987,310 | 10/1976 | Nirschl | 340/600 |
| 4,091,363 | 5/1978 | Siegel et al. | 340/629 X |

FOREIGN PATENT DOCUMENTS

| | | | |
|---|---|---|---|
| 1088836 | 10/1967 | United Kingdom | 340/630 |
| 1088976 | 10/1967 | United Kingdom | 340/629 |

*Primary Examiner*—John W. Caldwell, Sr.
*Assistant Examiner*—Daniel Myer
*Attorney, Agent, or Firm*—Michael J. Striker

[57] ABSTRACT

A fire alarm system comprises a central control station feeding through a plurality of parallel supply lines a direct current voltage to a corresponding plurality of remote alarm stations. Each station has a fire sensor including a reference ionization chamber and a measuring ionization chamber, both chambers being connected in series between the two supply lines and having a common intermediate electrode. A field effect transistor has a gate electrode connected to the intermediate electrode of the ionization chambers and a source drain conducting channel the conductivity of which is controlled by the gate electrode. The input resistance and the input capacitance of the field effect transistor is connected parallel to the reference ionization chamber and defines therewith a first relatively short time constant of about two seconds. A two-stage switching amplifier is controlled by the channel of the field effect transistor and its output controls a light emitting diode serving as an indicator of the operative condition of the alarm station. The switching amplifier includes an integrating capacitor defining with the input resistance of the amplifier a second relatively low time constant of about 20 milliseconds, for example. The difference between the two time constants is utilized for checking from the central station the operative condition of respective remote alarm stations.

9 Claims, 1 Drawing Figure

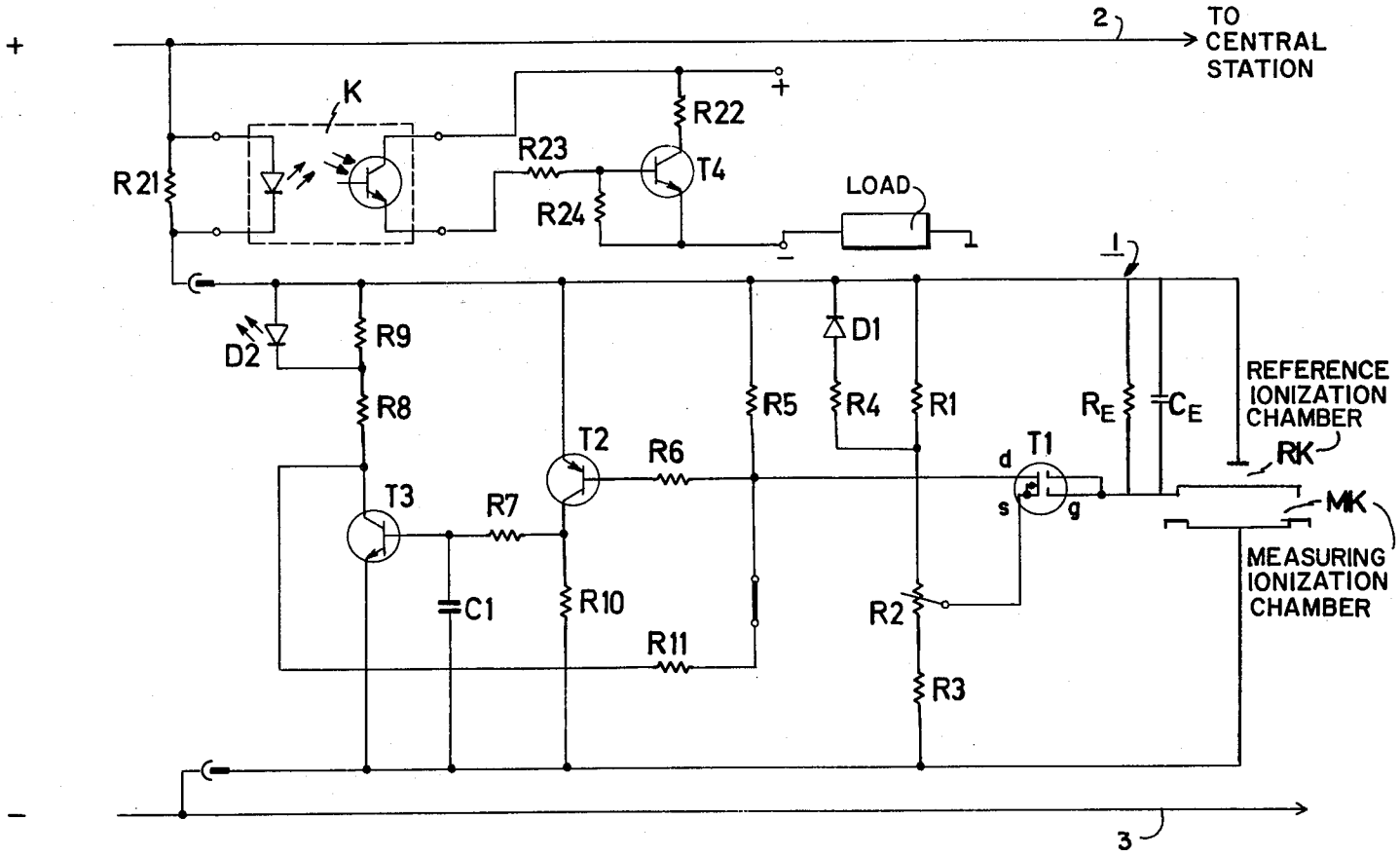
TO CENTRAL STATION
2
REFERENCE IONIZATION CHAMBER
RK
MK
MEASURING IONIZATION CHAMBER
CE
RE
1
T1
d
s
g
LOAD
R1
R2
R3
D1
R4
R5
R22
T4
R6
R11
T2
R10
R23
R24
R7
C1
K
R9
R8
T3
D2
R21
3
+
-

SMOKE ALARM STATION

BACKGROUND OF THE INVENTION

This invention relates generally to a remote smoke alarm station and more particularly it relates to such a station for use in a fire alarm system having a central control station and a plurality the remote smoke alarm stations each connected to the control station by a pair of direct current supply wires for feeding an ionization sensor of a smoke detecting circuit. Each detecting circuit includes a measuring ionization chamber connected in series via a common intermediate electrode with a reference ionization chamber; the intermediate electrode is connected to a gage electrode of a field effect transistor the output of which is connected to an electronic switching circuit having two stable states, namely a high ohmic state corresponding to a ready condition and a low ohmic state corresponding to an alarm condition which is signaled via the supply wires into the central station.

A fire alarm system of this kind is known from the German publication DT-OS No. 2,261,179. In order to avoid false alarms resulting from the activation of the alarm station caused by the response of the alarm station to interferences in the supply wires, each alarm station includes a control pulse generator and a resetting pulse generator for feeding an electronic switching circuit made for example in the form of a feedback switching amplifier having two stable states. This known system, however, does not make possible to test the operative condition of the respective alarm stations from the central station in spite of relatively complex circuitry in each alarm station. Since the alarm systems of this type have frequently an extremely large number of remote alarm stations, the cost of this system is relatively high.

From the German Patent DT-PS No. 1,566,687, a fire alarm system is also known which has parallel connected ionization alarm stations fed from corresponding direct current supply lines and having an electronic switching circuit which stores the alarm indication, that means, it remains activated even when the alarm releasing conditions have ceased to exist. In this system it is possible to extinguish from the central control station the stored alarm conditions in respective alarm stations by simply interrupting the supply voltage from the signaling and supply lines. However, when the operative condition of the alarm stations is to be tested from the central station, there is necessary to provide a third testing conduit in addition to the two supply conduits and moreover an indication circuit in the central station is necessary.

Finally, from the German publication DT-AS No. 1,766,440, a fire alarm system is known which permits the testing of working condition of respective alarm stations from the central station without the use of the third testing conductor. In this system, each signaling and supply line is not fed by a direct current voltage but instead, is fed by an alternating current voltage and each alarm station is designed such as to have a high impedance for one polarity of the supplied voltage and a low impedance for the other polarity of the supply voltage whereby in the case of a fire alarm the two impedances are reversed. The central station is provided with means for separate reading of the impedance between the conductors of a line during the change of the two polarity signs of the supplied voltage and thus distinguish between the activation caused by the alarm or by the interference. This arrangement, however, necessitates again a substantially increased cost of the circuitry involved; in addition such a system employing an alternating current for feeding the remote alarm stations is more sensitive to interference or false signals induced into the supply line than the system using alarm stations fed with a direct current voltage.

SUMMARY OF THE INVENTION

It is therefore an object of this invention to provide a fire alarm system of the above described type in which each remote smoke alarm station requires a relatively small number of component parts.

Another object of this invention is to provide such an improved fire alarm system which enables in a very simple manner to test the operative condition of individual remote alarm stations from the central control station.

According to this invention, the above objects are attained by providing in each remote smoke alarm station a field effect transistor having a source drain conducting channel and a gate defining an input capacity which is charged via the measuring ionization chamber, an electronic switching circuit having two stable states and including an integrating capacitor serving for suppressing short output signals from the field effect transistor and defining with the switching circuit a time constant which is shorter than the time constant of the input capacity and resistance of the field effect transistor so that by interrupting the supply voltage to the alarm station for a time period which is smaller than the time constant of the input capacitance and resistance of the field effect transistor but larger than the discharging time constant of the integrating capacitor, the switching condition indicative of an alarm is reset to its initial condition.

In the preferred embodiment, the electronic switching circuit is in the form of a feedback connected switching amplifier.

Preferably, the switching amplifier includes an input transistor controlled by the field effect transistor and a working transistor controlled by the input transistor, the integrating capacitor being connected parallel to the base-emitter circuit of the working transistor and the emitter collector circuit of the working transistor being connected between the supply conductors in series with a load resistor.

In order to make the sensitivity of the response of each smoke alarm station substantially independent from the ambient temperature, the source electrode of the field effect transistor is connected to a voltage divider which includes at least one semi-conductive element having temperature dependent resistance adapted for compensating the temperature dependence of the field effect transistor. This semi-conductive element can be, for example, a germanium diode connected in blocking direction.

Each smoke alarm station has an optical indicator for indicating its operative condition. Such an indication can be made in a very simple manner by extending the load resistor by at least two additional series resistors, one of which is connected in parallel to a light emitting diode.

In another embodiment which permits a remote optical indication of the operative condition of each alarm station, the load resistance which consists of three series connected resistors includes an electo-optical coupling member parallel connected to one of the load resistors. Preferably, the output of the electro-optical coupling member controls an amplifying transistor.

The novel features which are considered as characteristic of the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The single FIGURE illustrates a schematic circuit diagram of one embodiment of an alarm station of a fire alarm system of this invention.

DESCRIPTION OF THE PREFERRED EMBODIMENT

The smoke alarm station 1 includes a sensor assembled of a measuring ionization chamber MK, connected in series with a reference ionization chamber RK and connected via a resistor R21 across the conductors 2 and 3 of a line for supplying direct current voltage from a nonillustrated central station. The reference and measuring ionization chambers have a common intermediate electrode which is connected to a gate electrode g of a conductive N-channel field effect transistor R1 that hereinafter will be referred to shortly as FET. For reasons which will be explained below, the series connection of the measuring ionization chamber MK and the reference ionization chamber RK is connected to the supply voltage in such a manner that the resulting input capacitance CE and consequently the input resistance RE of the gate of FET T1 as indicated by dashed lines in the drawing are connected parallel to the reference ionization chamber RK.

The source electrode s of FET T1 receives, via the runner of a potentiometer R2 which is a part of a voltage divider, a bias voltage that is adjusted such that the FET T1 is normally blocked. The voltage divider includes a series connected resistor R1, the trimmer potentiometer R2 and resistor R3 whereby series connection of diode D1 connected in blocking direction and resistor R4 is connected parallel to the resistor R1. The diode D1, preferably a germanium diode connected in blocking direction, serves for compensating the temperature dependency of the sensitivity setting of the FET T1. The input resistance RE of FET T1 decreases namely with the increasing temperature. As a result, the gate voltage decreases and the FET becomes more sensitive. Since, however, the reverse current through the diode D1 simultaneously increases with the increasing temperature, the bias voltage from wiper of the trimmer potentiometer R2 shifts toward the more positive value of the direct current voltage supplied by the conductors of the supplied line, and the input sensitivity of the FET is temperature compensated and remains constant.

The drain electrode d of FET T1 is connected via resistor R5 to the positive potential. In addition, the drain electrode is connected via coupling resistor R6 to the bases of input P-N-P transistor T2 of a bistable switching amplifier having two complementary switches. Resistor R10 is connected in the collector circuit of this P-N-P transistor T2 and the collector of the latter transistor is coupled via coupling resistor R7 to the base of the complementary N-P-N transistor T3 acting as the working transistor of the switching amplifier. Parallel to the base-emitter path of the working transistor T3 a delay capacitor C1 is connected the function of which will be explained below. The collector of working transistor T3 is connected to the positive potential by series connected resistors R8 and R9. The collector of working transistor T3 is further connected via feedback resistor R11 to the common connection point of resistors R5 and R6 and the drain electrode of FET T1.

To indicate the condition of the alarm station, the light emitting diode D2 is connected across resistor R9 in the collector circuit of the working transistor T3. In addition, an electro-optical coupling circuit K can be connected if desired parallel to the resistor R21 which acts as a common load resistor for the whole alarm station. The electro-optical coupling member enables an external indication of the condition of the alarm station through its power supply line without noticeably loading the latter. The output circuit of the electro-optical coupling member is connected via a voltage divider formed by resistors R23 and R24 to the base of a booster transistor T4 the collector of which is connected to a separate current source via resistor R22.

Provided that the remote indication and consequently the electro-optical coupling member K is dispensed with, the common load resistor R21 can also be removed without the necessity to modify the values of the component parts of the circuit in the alarm station proper. In other words, the load resistor 21 serves merely for the generation of an input voltage for the particular electro-optical coupling member.

The operation of the above-described alarm station is as follows:

(a) Switching-on step

When the operating direct current voltage is applied to the supply lines 2 and 3 then due to the fact that the input capacitance CE of the FET T1 is connected parallel to the reference ionization chamber, the prevailing part of the supplied voltage at the moment of switching-on is applied across the measuring ionization chamber MK. With increasing charging of this input capacitance CE through the measuring ionization chamber MK, the gate potential of the FET decreases from its initial positive value to a voltage which upon the completion of the charging of capacitance CE is determined by the voltage divider constituted by the measuring ionization chamber MK and the series connected circuit formed by the parallel connection of the reference ionization chamber RK and the input resistance RE of the FET T1.

The resulting time constant determined by the input capacitance CE is set to be several seconds, for example five seconds, so that the check-up of the working condition of the alarm station can be carried out in a veryy simple manner, as it will be explained below.

(b) In the case of an alarm

When smoke enters the measuring ionization chamber MK, the resistance of the latter increases. As a result, the gate potential of the FET T1 grows more positive, its channel resistance becomes low ohmic and a current starts flowing via resistor R5, the conductive channel between the source and drain of the FET T1, potentiometer R2 and resistor R3. This current generates a voltage drop across the resistor R5 which renders the input transistor T2 of the switching amplifier conductive. The working transistor T3 of the switching amplifier becomes therefore also conductive with a small delay determined by the delay capacitor C1. The collector potential of transistor T3 which thus drops toward the negative potential is fed back via resistors R11 and R6 to the base of the input transistor T2 so that the switching process from the high ohmic to the low ohmic condition of the switching amplifier is accelerated and besides, the low ohmic switching condition is maintained even when the control signal generated by FET T1 disappears. In this manner, the switching amplifier acts also for storing the alarm signal.

The current of several milliamperes for example, flowing during the low ohmic condition of the switching amplifier from the positive line conductor via resistor 21 and the electro-optical coupling member K, the resistor R9 and the light emitting diode D2, resistor R8 and the working transistor T3 to the negative line conductor, provides for the registration of the alarm signal in the non-illustrated central station then. The electro-optical coupling member K causes the switching to a low ohmic condition of amplifier T4 of a remote indicator and finally activate the light emitting diode D2 of the alarm station itself.

(c) Switching-off step

If the supply voltage is interrupted, two discharging or clearing processes take place:

Capacitor C1 discharges via resistors R7 and R10.

The input capacity CE of the FET T1 discharges via the reference ionization chamber RK.

The time constant of delay capacitor C1 is selected by a suitable adjustment of the capacitor C1 such that it is relatively short such as for example about 20 millisecond so that during the reconnection of the supply voltage the working transistor T3 is not reactivated by the residual load of the capacitor C1.

The input capacity CE of the FET T1 discharges through the reference ionization chamber RK. After about two seconds, the discharge progresses so far that on a new switching-on of the supply voltage the loading current of the input capacity CE permits the generation of a new alarm signal.

The difference between the two time constants is utilized for the clearance of the stored alarm condition. In order to extinguish or clear the existing state of the alarm station, the supply voltage of the alarm station (or of the whole alarm line) is interrupted for a time period which is larger than the time constant determined by delay capacitor C1 but smaller than the time constant determined by the input capacitance CE, that means in the given example the interruption period lies between 20 milliseconds and 2 seconds. Provided that during this interruption no or negligible amount of aerosols take place in the measuring ionization chamber MK, the switching amplifier T2 and T3 resumes due to such an interruption its high ohmic state again, nonetheless the electrical potentials at the input of the circuit of the alarm station change so little that no false alarm is generated.

A short variation of the potential on the drain electrode of the FET T1 which occurs due to the reapplication of the supply voltage as well as due to other impulsive interferences occuring during the above-mentioned interruption period, do not switch the switching amplifier into its low ohmic state because the integrating capacitor C1 is not sufficiently charged by the instantaneous conductivity of the input transistor T2 to make the working transistor T3 conductive.

Because of the considerable difference between the two time constants the time necessary for the switching off or interruption of the supplied voltage and thus of the clearing of the start alarm condition is not critical.

(d) The check-up of operative condition

The switching-on process of the alarm station of the entire alarm transmitting line is employed simultaneously as a check-up step of the operative condition of the latter. In the first place, all alarm stations have to be switched on into their alarm condition. Subsequently, this alarm condition is extinguished by the aforementioned momentary interruption of the supply voltage and all alarm stations are brought into their normal rest condition.

If an alarm station becomes excessively polluted due to adverse ambient conditions, so it cannot be extinguished in the above manner. This malfunctioning alarm unit can be easily pinpointed either by means of the light emitting diode D2 and/or by means of the remote indicator K, and exchanged.

What is claimed as new and desired to be protected by Letters Patent is set forth in the appended claims:

1. In a fire alarm system having a central control station and a plurality of remote smoke alarm stations connected, respectively, to the control station by a pair of supply conductors for delivering a direct current voltage, a combination comprising in each of said alarm stations a smoke sensor including a reference ionization chamber and a measuring ionization chamber, said chambers being connected in series between said supply conductors and having a common intermediate electrode, a field effect transistor having a source, a drain and a gate, said gate being connected to said intermediate electrode, and a conductive channel between said source and drain being controlled by said gate, said source and said drain being coupled to said supply conductors in such a manner that the input capacitance and the input resistance of said field effect transistor are parallel to said reference ionization chamber and define therewith a relatively long first time constant; a two stage switching amplifier coupled between said supply conductors and having an input and an output, said input being controlled by said conductive channel and having an input resistance; an integrating capacitor coupled to said input resistance of said switching amplifier to define therewith a second time constant which is shorter than said first time constant; and indicating means coupled to said output of the switching amplifier to indicate the operative condition of said alarm station.

2. The combination as defined in claim 1 wherein said switching amplifier includes a feedback circuit.

3. The combination as defined in claim 2 wherein said switching amplifier includes two complementary transistor stages, the first stage being controlled by said channel of said field effect transistor, said integrating capacitor being connected across the base emitter path of said second stage transistor and the emitter collector path of the second stage transistor being connected between said supply conductors in series with a load resistor.

4. The combination as defined in claim 3 further including a voltage divider connected between said supply conductors for supplying a bias voltage to the source electrode of said field effect transistor, a part of said voltage divider including a temperature sensitive semiconductive element for compensating the temperature sensitivity of said field effect transistor.

5. The combination as defined in claim 4 wherein said temperature sensitive semiconductive element is a germanium diode connected in blocking direction parallel to a part of said voltage divider.

6. The comination as defined in claim 3 wherein the load resistor of said second stage of said switching amplifier includes series connected resistors and said indicating means including a light emitting diode connected parallel to one of said resistors.

7. The combination as defined in claim 6 wherein said series connection of load resistors includes an additional series resistor connected to one of said conductors and an electro-optical coupling member connected in parallel to said additional resistor.

8. The combination as defined in claim 7 wherein said electro-optical coupling member further includes an amplifying transistor connected to its output and fed by a separate source.

9. A smoke alarm station comprising D.C. supply conductors; a reference ionization chamber and a measuring ionization chamber connected in series between said conductors; a field effect transistor having a gate circuit connected parallel to said reference ionization chamber, a conductive source-drain channel controlled by said gate circuit, said gate circuit having an input capacity which is charged via said measuring ionization chamber and an input resistance defining with said input capacity a relatively long, first time constant; a bistable switching circuit fed by said conductors and controlled by said source drain channel, said switching circuit including an integrating capacitor for suppressing short output signals from said channel, said capacitor defining with said switching circuit a second time constant which is shorter than said first time constant of said gate circuit so that by interrupting the direct current from said supply conductors for a time period which is between said first and second time constants, the switching condition of said switching circuit indicative of an alarm is reset to the other switching condition.

* * * * *